United States Patent [19]

Dempsey

[11] Patent Number: 4,594,747

[45] Date of Patent: Jun. 17, 1986

[54] WORK SUPPORT WITH CLEANING STRUCTURE

[76] Inventor: Mary A. Dempsey, 171 Brickyard Rd., Cranbury, N.J. 08512

[21] Appl. No.: 669,586

[22] Filed: Nov. 8, 1984

[51] Int. Cl.[4] ..... A47L 7/00; A61D 3/00

[52] U.S. Cl. ..... 15/301; 119/103

[58] Field of Search ..... 119/103; 15/300 R, 301, 15/310, 303; 269/21

[56] References Cited

U.S. PATENT DOCUMENTS

| | | | |
|---|---|---|---|
| 352,262 | 11/1886 | Phelps et al. | 119/103 |
| 1,037,081 | 8/1912 | Thorne | 15/303 |
| 1,252,127 | 1/1918 | Long | 15/303 |
| 3,216,043 | 11/1965 | Lipson | 15/310 |
| 3,411,174 | 11/1968 | Jordar | 15/310 |
| 3,524,434 | 8/1970 | Finley | 119/103 |

*Primary Examiner*—Hugh R. Chamblee

*Attorney, Agent, or Firm*—Thomas F. Meagher

[57] ABSTRACT

A grooming table, via one or more suction or vacuum orifices located upon or aside the grooming table work surface, is self-cleaning. Shorn animal fur or hair, resulting from the grooming operation, is drawn from the work surface into a refuse container. A vacuum or suction source is provided to the orifice or orifices via one or more vacuum containing and directing structures, all of which may be located beneath the grooming table work surface.

9 Claims, 5 Drawing Figures

WORK SUPPORT WITH CLEANING STRUCTURE

The present invention relates to a work support with a cleaning structure and, more particularly, to an animal grooming table with automatic means to clean the surface of the grooming table during or after the grooming operation.

Grooming tables for restraining an animal during the grooming operation, while providing a work support or surface for the animal, are known. The grooming operation, which typically includes the shearing, in various degrees, of the fur or hair of the animal, results in sheared fur or hair dropping to the surface of the grooming table. The presence and aggregation of the sheared fur or hair requires, in many instances, its removal during the shearing operation, necessitating the groomer to interrupt the grooming operation. Additionally, sheared hair often will drop to the floor upon which the grooming table is situated, as well as upon the clothing and body surface of the groomer, requiring its removal after time intervals of its aggregation. These situations also result in interruptions of the grooming operation, all of which contribute to economic inefficiencies for the grooming business operators.

In addition to the business interruptions which result from the need for the removal of shorn fur or hair aggregations, the continued presence of shorn hair or fur aggregations presents sanitation problems owing to the occasional presence of diseased fur or hair. Also, the presence of shorn fur or hair aggregations results in an unaesthetic appearance at the grooming location.

Suction devices have been incorporated into grooming devices to draw away shorn fur or hair from the animal being groomed. However, such devices have proven cumbersome during the grooming operation, resulting in less accurate shearing as well as tiring of the groomer because of their additional weight and their vacuum source connections.

It is a general object of the present invention to avoid and overcome the foregoing and other difficulties of known grooming tables and devices by providing a grooming table which provides for the automatic cleaning of its surface.

The aforementioned general object, and other objects, are acheived by providing a grooming table which, via one or more suction or vacuum orifices located upon or aside the grooming table work surface, is self-cleaning. Shorn animal fur or hair, resulting from the grooming operation, is drawn from the work surface into, for example, a refuse container. A vacuum or suction source is provided to the orifice or orifices via one or more vacuum containing and directing structures, all of which may be located beneath the grooming table work surface. Sound-proofing side panels may be provided to lessen the attendant noise resulting from the vacuum operation. One or more groomer-operated control devices, such as a foot-operated switch and a hand-operated switch, may also be provided. Such control devices allow the groomer to choose whether or not to have the vacuum operation continuous throughout the grooming operation.

The principles of the invention will be more fully appreciated from the illustrative embodiments in the drawings, in which.

Figure 1:
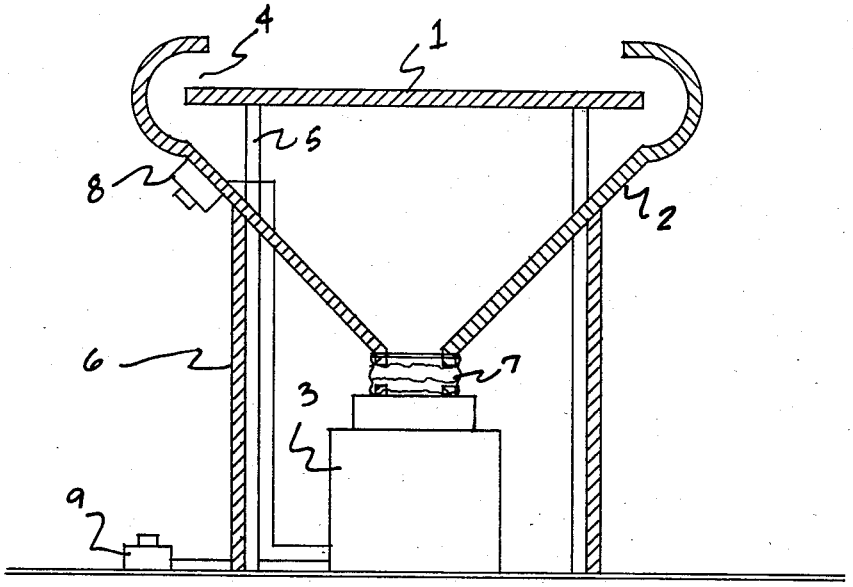
FIG. 1 shows a section view of a general embodiment of the invention.

As shown in FIG. 1, a section view of the invention, an animal grooming table with a supporting work surface 1 has a structure 2 located adjacent the work surface which provides a suction force from a vacuum source 3 to the work surface via the orifice 4. Shorn fur or hair from animals placed on the work surface for grooming is thereby drawn away from the animal and from the work surface. The orifice 4 results from the spacing between the work surface and the suction-providing structure. The work surface is supported by support legs 5. Noise from the vacuum source, which is located beneath the work surface, is confined by providing side-panels 6 which are comprised of sound-proofing material. A flexible, telescoping sleeve 7 is provided to connect the suction-providing structure to the vacuum source. The vacuum source includes a containment structure portion for containing the shorn fur or hair drawn by the vacuum source. A first control switch 8, located on the outer surface of the suction-providing structure, is provided to allow the groomer to control the vacuum source by hand. A second control switch 9, located adjacent the side-panels at floor-level, is provided to allow the groomer to control the vacuum source by foot.

Figure 2:
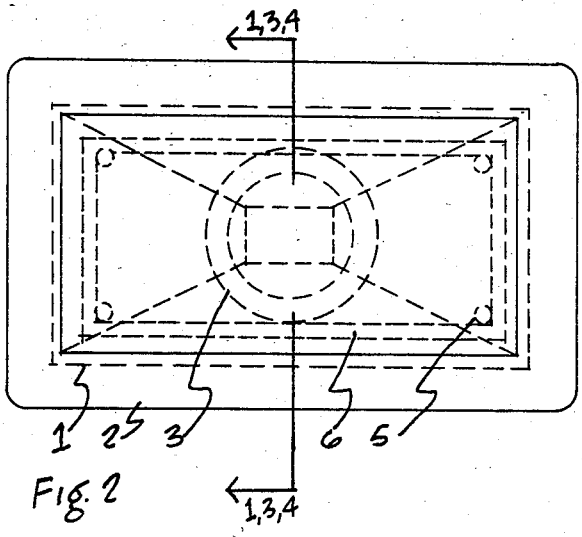
FIG. 2 shows a plan view of the general embodiment of FIG. 1.
Figure 3:
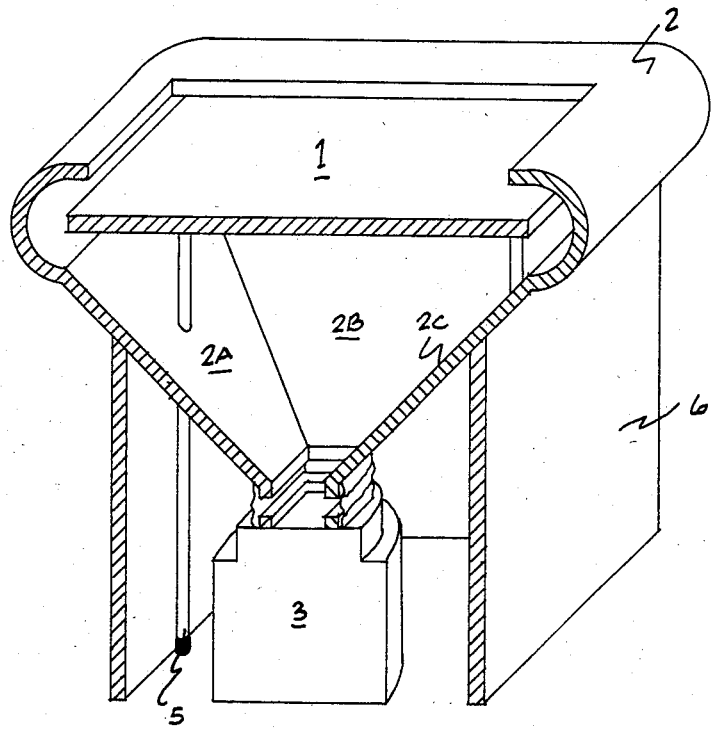
FIG. 3 shows an oblique section view of the general embodiment of FIG. 1.

FIG. 2 shows a plan view of the invention as shown in FIG. 1. FIG. 3 shows an oblique section view of the invention as shown in FIG. 1. The suction-providing structure has four portions which slope from the orifice portion at the top of each side of the structure to the narrower bottom portion located near and above the vacuum source. Three of the four portions 2A, 2B, and 2C, are shown in part in FIG. 3.

Figure 4:
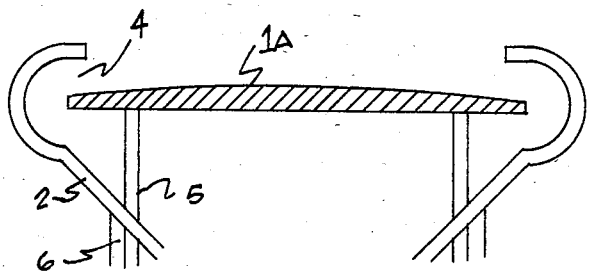
FIG. 4 shows a section view of a portion of an alternative embodiment of the invention.

FIG. 4 shows a section view of an alternative work surface structure which is mounded so that the suction force is supplemented by the gravity force in drawing shorn fur or hair away from the work surface.

Figure 5:
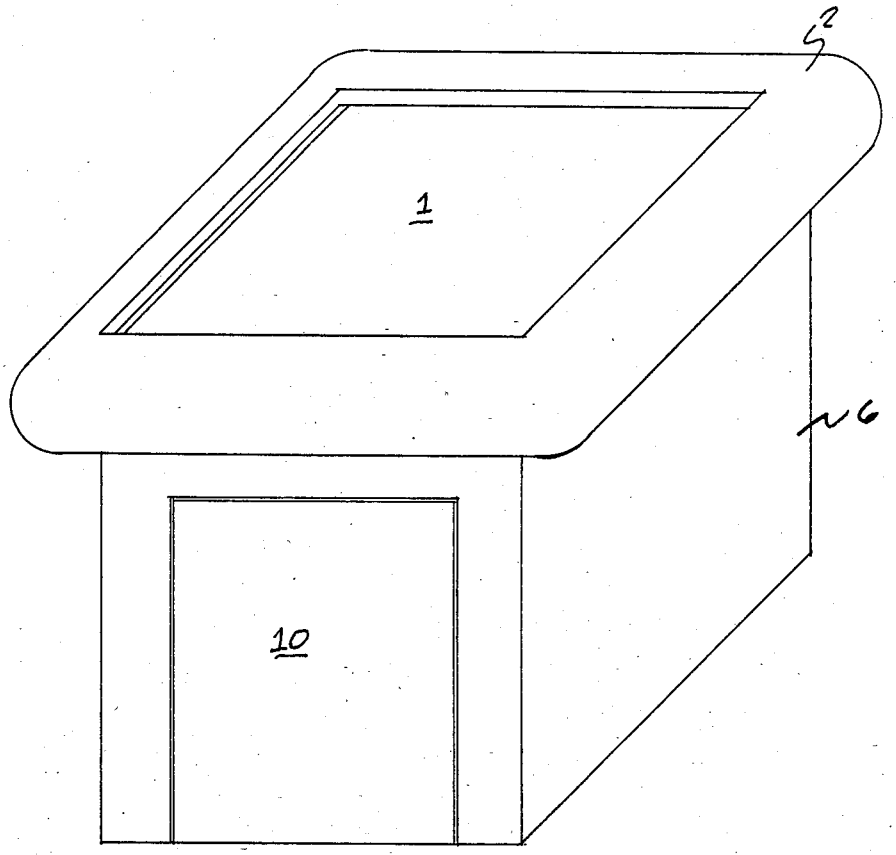
FIG. 5 shows an oblique elevation view of the general embodiment of FIG. 1.

FIG. 5 shows an oblique elevation view of the invention. A door or panel 10, also comprised of sound-proofing material, provides access to the vacuum source for refuse removal and vacuum source maintenance and repair.

A grooming post, connected to the grooming table, may also be provided in order to aid the groomer in holding the animal on the grooming table. A screen may be provided across the orifice to prevent the insertion of objects, such as the feet of the animal, into the suction-providing structure. The support legs and side-panels may be adjustable to allow for adjusting the level of the work surface. Additionally, the vacuum source and refuse containment structure may be located away from the work surfaces, rather than below it, such as in an adjacent room.

An alternative embodiment of the invention differs from the previously-described embodiment in that the single suction-providing structure is replaced by a plurality of such structures, such as vacuum hoses, leading from the vacuum source to a plurality of orifices located adjacent the work surface.

The invention may also be used in environments other than the animal grooming environment, such as in the work-shop environment. For example, a wood work object may be supported on a similar work surface. Work performed on the object, such as sawing, drilling, or carving, results in wood shavings, chips, and dust. The work surface may be cleaned in the previously-described manner.

While the present invention has been described in connection with a preferred embodiment thereof, it is to be understood that additional embodiments, modifications, and applications which will become obvious to those skilled in the art are included within the spirit and scope of the invention as set forth by the claims appended hereto.

I claim:

1. A self-cleaning work support, comprising:

means for providing a suction force;

a table work surface, for supporting a work object;

table surface support means, connected beneath said table work surface, for supporting said table work surface spaced above a floor surface; and, a suction directing means, supported slightly above and over to encompass a peripheral edge of said table work surface, and extending downwardly forming an exhaust funnel, connected to said suction providing means, for directing a suction force from said suction providing means downwardly onto the top surface of said table work surface between the peripheral edge of said table work surface and said suction directing structure, whereby removed portions of said work object are drawn away from said table work surface by said suction force.

2. A work support according to claim 1, wherein said suction providing means comprises a vacuum source.

3. A work support according to claim 1, further comprising: means, coupled to said suction providing means, to control said suction providing means.

4. A work support according to claim 1, further comprising: means, enclosing said suction providing means, for confining sound emanating from said suction providing means.

5. A work support according to claim 1, wherein said table work surface comprises a structure having a mounded surface.

6. A self-cleaning animal grooming table, comprising:

a vacuum source;

a table work surface for supporting an animal during a grooming operation;

table surface support means, connected beneath said table work surface, for supporting said table work surface spaced above a floor surface; and a suction directing structure, supported slightly above and over to encompass a peripheral edge of said table work surface, and extending downwardly forming an exhaust funnel, connected to said vacuum source, for directing a suction force from said vacuum source downwardly onto the top surface of said table work surface between the peripheral edge of said table work surface and said suction directing structure, whereby shorn hair from said animal is drawn away from said table work surface by said suction force.

7. A grooming table according to claim 6, further comprising:

means, coupled to said vacuum source, to control said vacuum source.

8. A grooming table according to claim 6, further comprising:

means, enclosing said vacuum source, for confining sound emanating from said vacuum source.

9. A grooming table according to claim 6, wherein said table work surface comprises a structure having a mounded surface.

* * * * *